US009525929B2

(12) United States Patent
Burgett et al.

(10) Patent No.: US 9,525,929 B2
(45) Date of Patent: Dec. 20, 2016

(54) VARIABLE OCCLUSION HEADPHONES

(71) Applicant: Harman International Industries, Inc., Stamford, CT (US)

(72) Inventors: Seth D. Burgett, Glen Carbon, IL (US); Michael Joseph Spenner, Town & Country, MO (US)

(73) Assignee: Harman International Industries, Inc., Stamford, CT (US)

( * ) Notice: Subject to any disclaimer, the term of this patent is extended or adjusted under 35 U.S.C. 154(b) by 0 days.

(21) Appl. No.: 14/667,658

(22) Filed: Mar. 24, 2015

(65) Prior Publication Data

US 2015/0281827 A1 Oct. 1, 2015

Related U.S. Application Data

(60) Provisional application No. 61/970,890, filed on Mar. 26, 2014.

(51) Int. Cl.
*H04R 25/00* (2006.01)
*H04R 1/10* (2006.01)

(52) U.S. Cl.
CPC ..... *H04R 1/1041* (2013.01); *H04R 1/1008* (2013.01); *H04R 2460/05* (2013.01)

(58) Field of Classification Search
CPC ... H04R 1/1008; H04R 1/1083; H04R 1/2826; H04R 2460/11
See application file for complete search history.

(56) References Cited

U.S. PATENT DOCUMENTS 5,497,427 A * 3/1996 Nageno ..... H04R 5/033 381/381
7,391,878 B2 * 6/2008 Liao ..... H04R 5/033 381/370
8,199,955 B2 * 6/2012 Akino ..... H04R 1/1008 381/332
8,655,003 B2 * 2/2014 Duisters ..... H04R 1/1041 381/375
9,191,744 B2 * 11/2015 Anderson ..... H04R 5/04
2001/0046304 A1 * 11/2001 Rast ..... H04R 1/1041 381/74
2005/0105755 A1 * 5/2005 Yueh ..... H04R 1/1041 381/371
2007/0189544 A1 * 8/2007 Rosenberg ..... H03G 3/32 381/57

* cited by examiner

*Primary Examiner* — Curtis Kuntz
*Assistant Examiner* — Ryan Robinson
(74) *Attorney, Agent, or Firm* — Brooks Kushman P.C.

(57) ABSTRACT

An adjustable occlusion headphone includes a housing having a face, a resilient seal member on the housing, adapted to surround the user's ear, and with the face of the housing form a chamber enclosing the user's ear. A speaker communicates through the face of the housing to provide sound to the user's ear. There is at least one port in the face of the housing. A passage extends from each port to the exterior of the housing. A valve member associated with each passage, is operable between an open position and a closed position, and an operator for operating each valve member between its open and closed position to control sound communication from outside the housing to the chamber.

19 Claims, 8 Drawing Sheets

VARIABLE OCCLUSION HEADPHONES

CROSS-REFERENCE TO RELATED APPLICATIONS

This Utility Patent Application claims priority to U.S. Provisional Application No. 61/970,890, filed Mar. 26, 2014, which the disclosure is incorporated herein.

BACKGROUND

This section provides background information related to the present disclosure which is not necessarily prior art.

This invention relates to headphones and in particular to variable occlusion headphones.

Headphones typically comprises left and right ear elements connected by a head band. Each of the ear elements comprising a housing having a face adapted to face the wearer's ear. A resilient seal member disposed on the housing is adapted to surround the user's ear, and with the face of the housing form a chamber enclosing the user's ear. A speaker is provided in the housing, communicating through the face of the housing to provide sound to the user's ear. This type of headphone, while comfortable and providing excellent sound to the wearer, acoustically isolates the wearer from the surrounding environment. While this is conducive to providing a high quality uninterrupted listening experience, there can be some undesirable consequences to not being aware of important communications and warnings.

SUMMARY

This section provides a general summary of the disclosure, and is not a comprehensive disclosure of its full scope or all of its features.

Embodiments of the present invention provide headphones that reduce or eliminate some of the undesirable consequences of sound occluding headphones. Generally, an adjustable occlusion headphone in accordance with the principles of a first preferred embodiment of this invention comprises a housing having a face, and a resilient seal member on the housing, adapted to surround the user's ear, and with the face of the housing form a chamber enclosing the user's ear. There is a speaker communicating through the face of the housing to provide sound to the user's ear. There is at least one port in the face of the housing, and a passage extending from each port to the exterior of the housing. A valve member is associated with each passage, and is operable between an open position and a closed position to open and close the passage. An operator is provided for operating each valve member between its open and closed position to control sound communication from outside the housing to the chamber.

The operator can comprise an electric motor, a piezoelectric element, an electrostrictive element, or a solenoids. In some embodiments the valve member is disposed at the port in the face of the housing, in other embodiments it is located in the passage intermediate the port and the exterior of the housing, and still other embodiments the valve member is located at the opening of the passage to the exterior of the housing.

The headphones preferably further comprise a sensor for sensing sound outside the housing; and a processor programmed to process the sensed sound, and in response to the processes sound signal control the operator to operate the valve member. The processor can be programmed to control the operator to move the valve member to an open position based upon at least one of the volume, frequency, or duration of the sensed sound. For example, the processor is programmed to control the operator to move the valve member to an open position when the sensor senses sound in excess of a predetermined threshold, or when the sensor senses sound in excess of a predetermined threshold for a predetermined period of time, or when the sensor senses a repeated sound.

Generally, an adjustable occlusion headphone in accordance with the principles of a second preferred embodiment of this invention comprises a housing having a face, and a resilient seal member on the housing, adapted to surround the user's ear, and with the face of the housing form a chamber enclosing the user's ear. There is a speaker communicating through the face of the housing to provide sound to the user's ear. The earphones include a sensor for sensing sound outside the housing; and a processor programmed to process the sensed sound, and in response to the processed sound signal, selectively transmit sound sensed by the sensor to the user via the speaker.

The processor is programmed to communicate sensed sound to the speaker based upon at least one of the volume, frequency, or duration of the sensed sound. For example the processor can be programmed to communicate sensed sound to the speaker when the sensor senses sound in excess of a predetermined threshold, or when the sensor senses sound in excess of a predetermined threshold for a predetermined period of time, or when the sensor senses a repeated sound.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
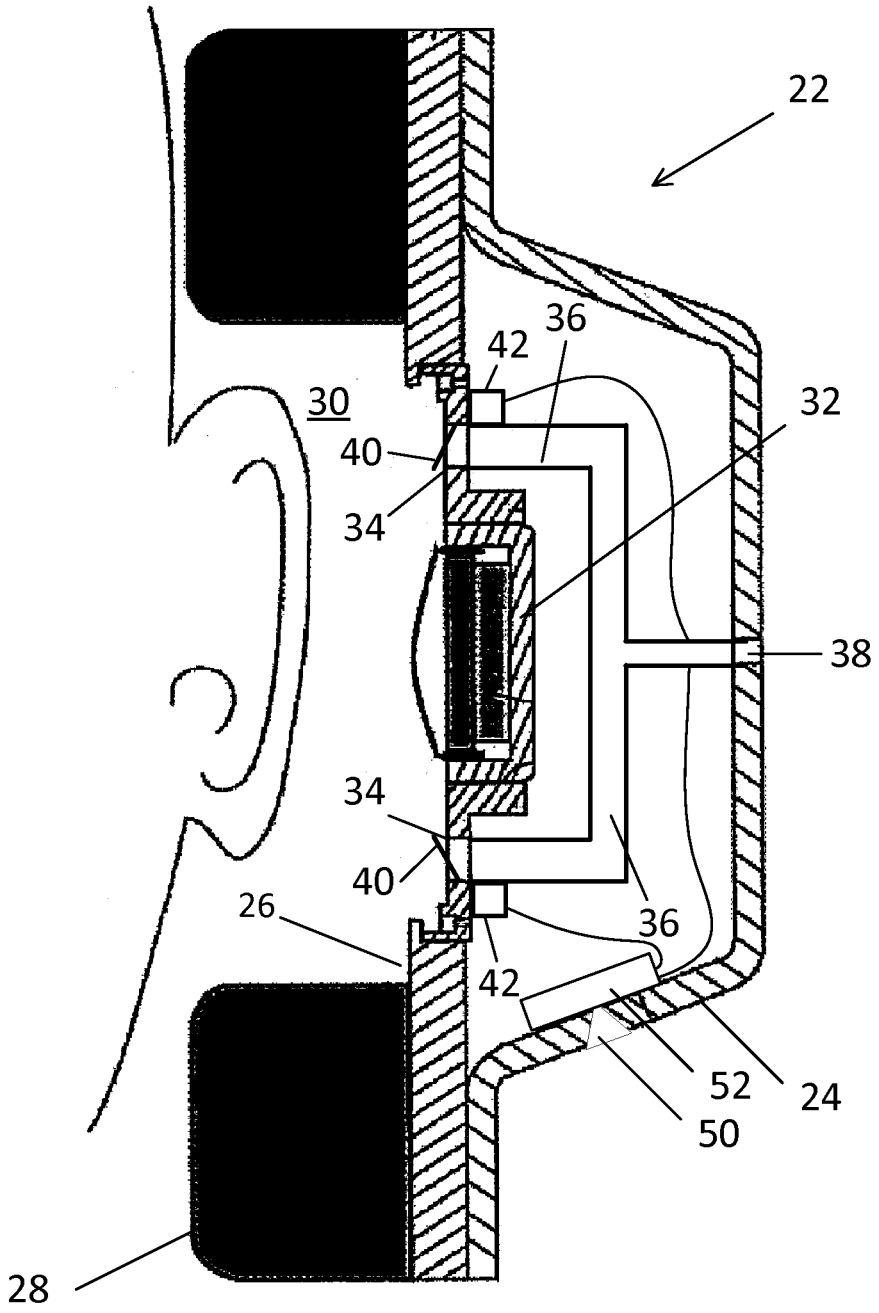
Figure 7:
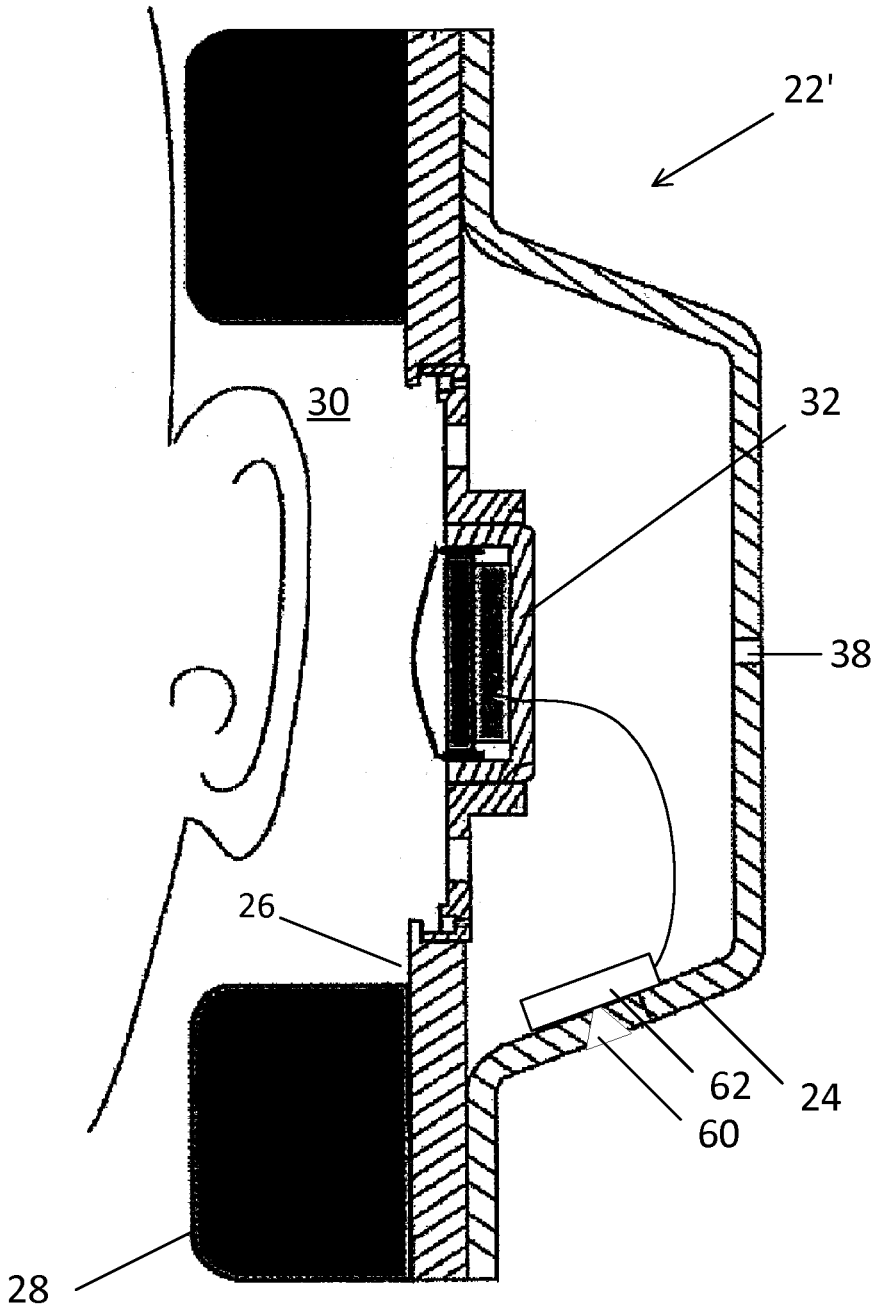
Figure 8:
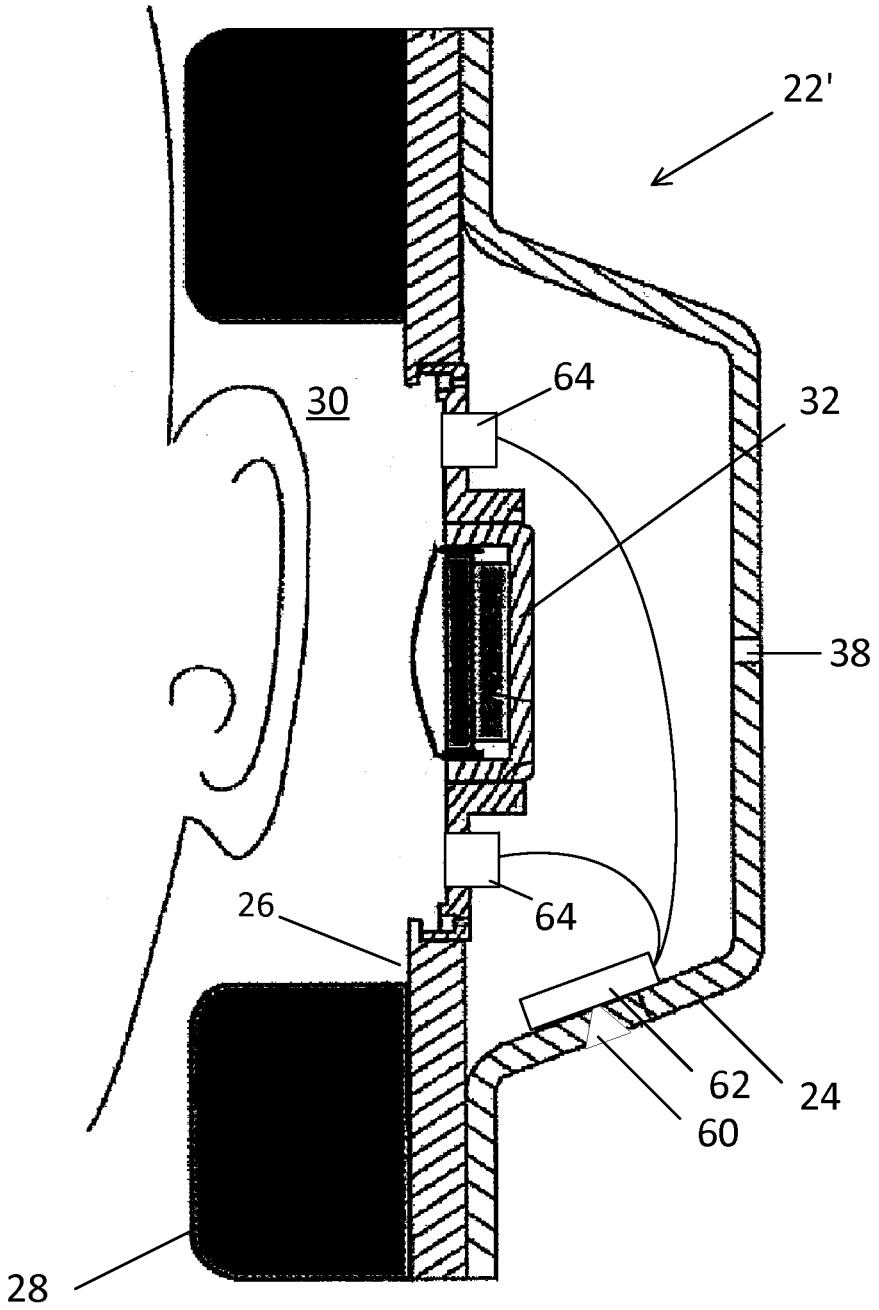

FIG. 6 is vertical cross sectional view of the headphones showing a valve member is disposed at the port in the face of the housing, FIG. 7 is vertical cross sectional view of an earpiece for headphones according to a second preferred embodiment of the invention; and FIG. 8 is vertical cross sectional view of an alternative construction of the earpiece for headphone according to a second preferred embodiment of the invention.

Corresponding reference numerals indicate corresponding parts throughout the several views of the drawings.

DETAILED DESCRIPTION

Example embodiments will now be described more fully with reference to the accompanying drawings.

Embodiments of the present invention provide headphones that reduce or eliminate some of the undesirable consequences of sound occluding headphones. An adjustable occlusion headphone in accordance with the principles of a first preferred embodiment of this invention is indicated generally as 20 in FIGS. 1-9. The headphones 20 preferably include at least one earpiece 22 comprising a housing 24 having a face 26, and a resilient seal member 28 on the housing, adapted to surround the user's ear, and with the face of the housing form a chamber 30 enclosing the user's ear.

A speaker 32 is disposed in the housing and communicates through the face 26 of the housing 24 to provide sound to the user's ear. There is at least one port 34 in the face 26 of the housing 24, and a passage 36 extending from each port to at least one opening 38 the exterior of the housing. Each passage can terminate in its own opening 38, or as shown they can all open to the same opening. The passage 36 can be molded into the housing 24, formed by tubing, or otherwise. A valve member 40 is associated with each passage 36, and is operable between an open position and a closed position to open and close the passage. An operator 42 is provided for operating each valve member 40 between its open and closed position to control sound communication from outside the housing 24 to the chamber 30 adjacent the user's ear.

Figure 1:
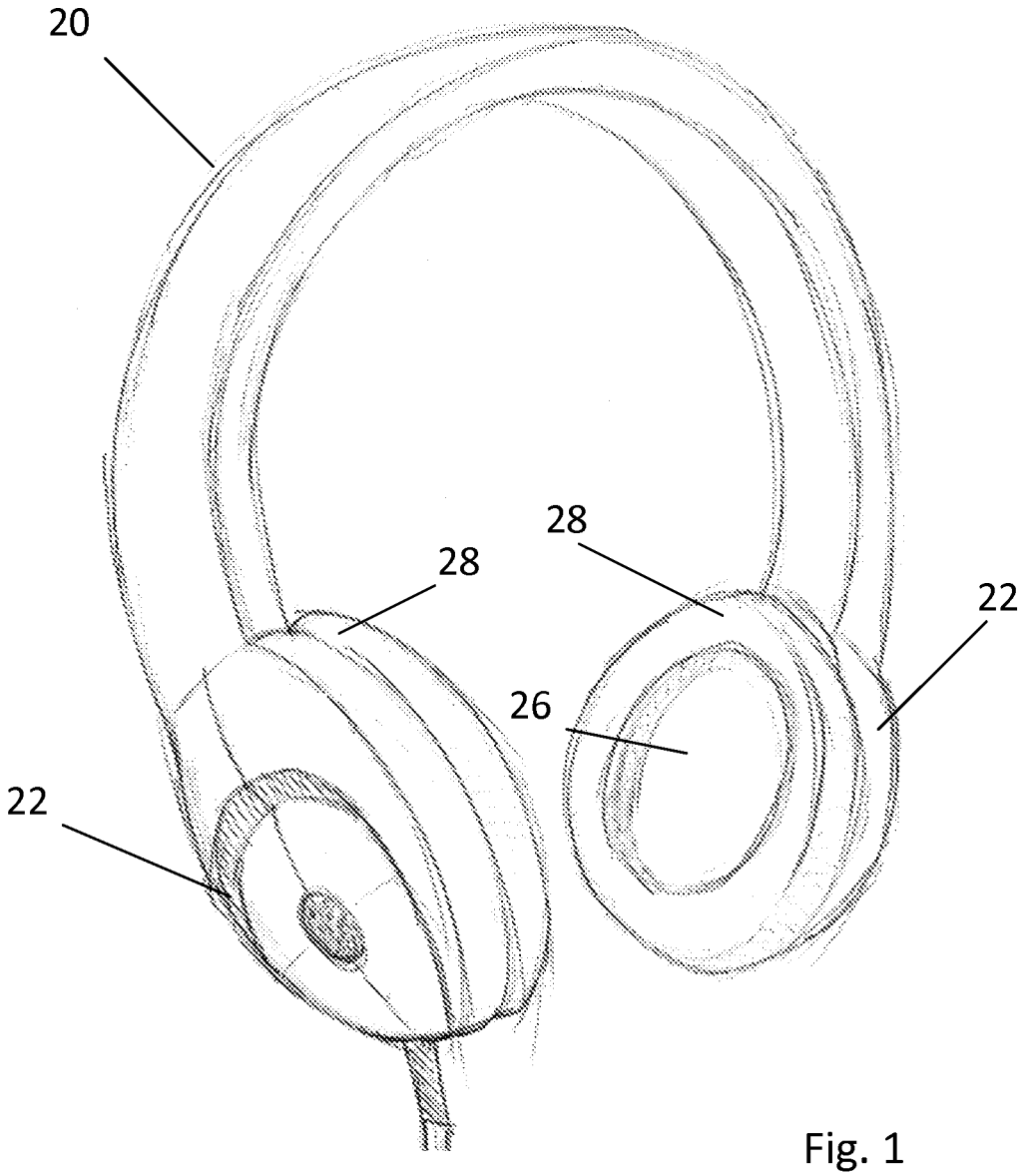
FIG. 1 is a perspective view of headphones constructed according to a first preferred embodiment of the invention.
Figure 2:
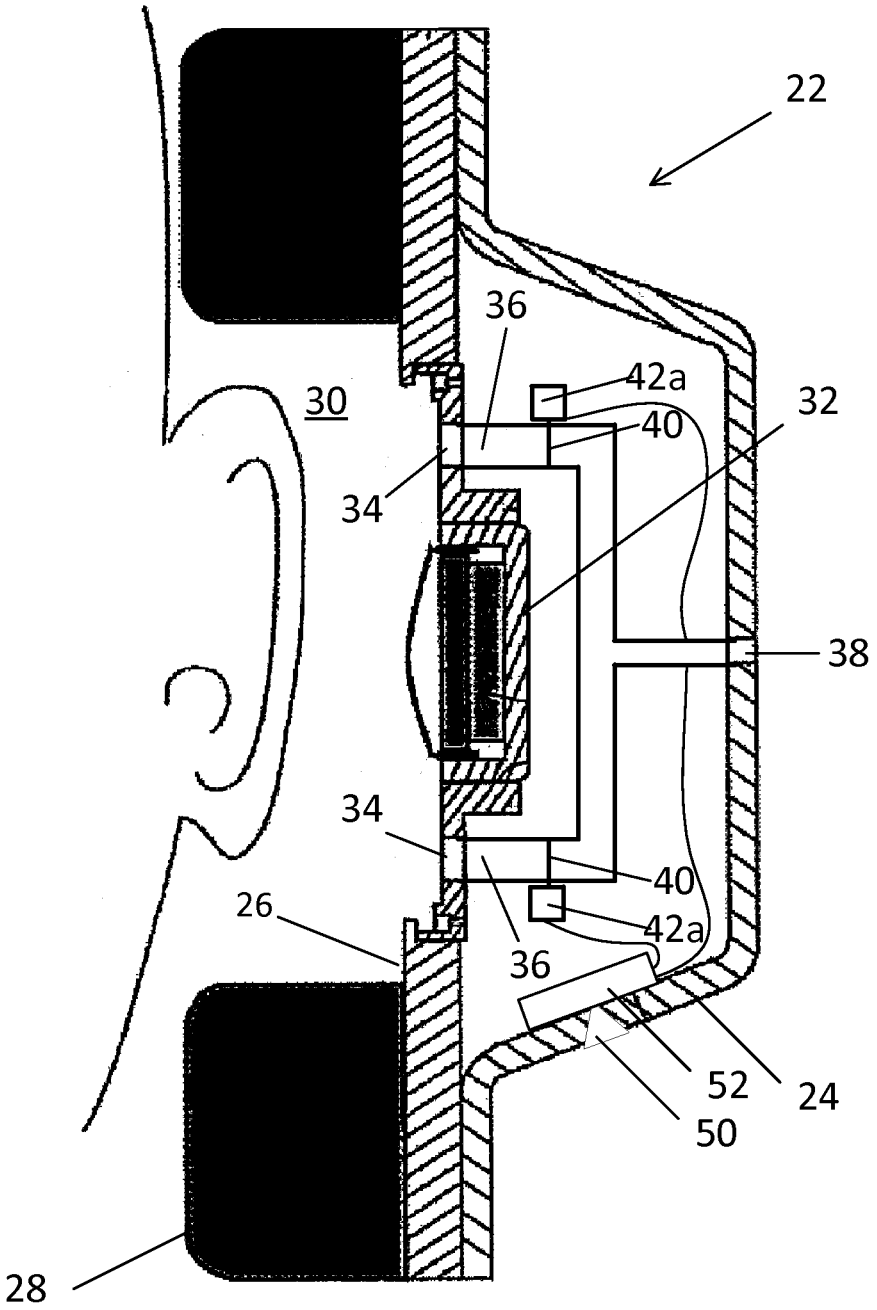
FIG. 2 is a vertical cross sectional view of headphones according to a first preferred embodiment of the invention, showing an electric motor operator.
Figure 3:
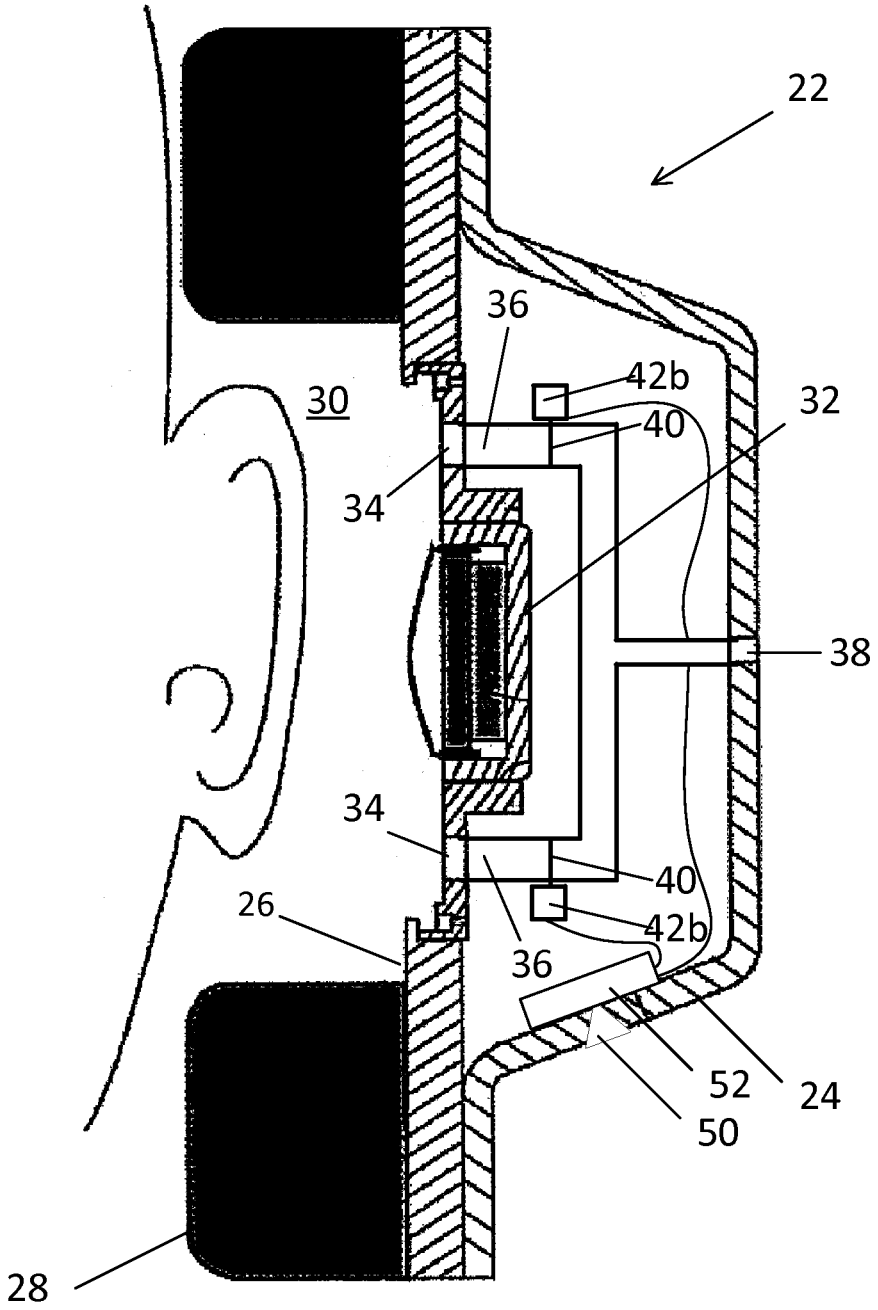
FIG. 3 is a vertical cross sectional view of headphones according to a first preferred embodiment of the invention, showing a piezoelectric element operator.
Figure 4:
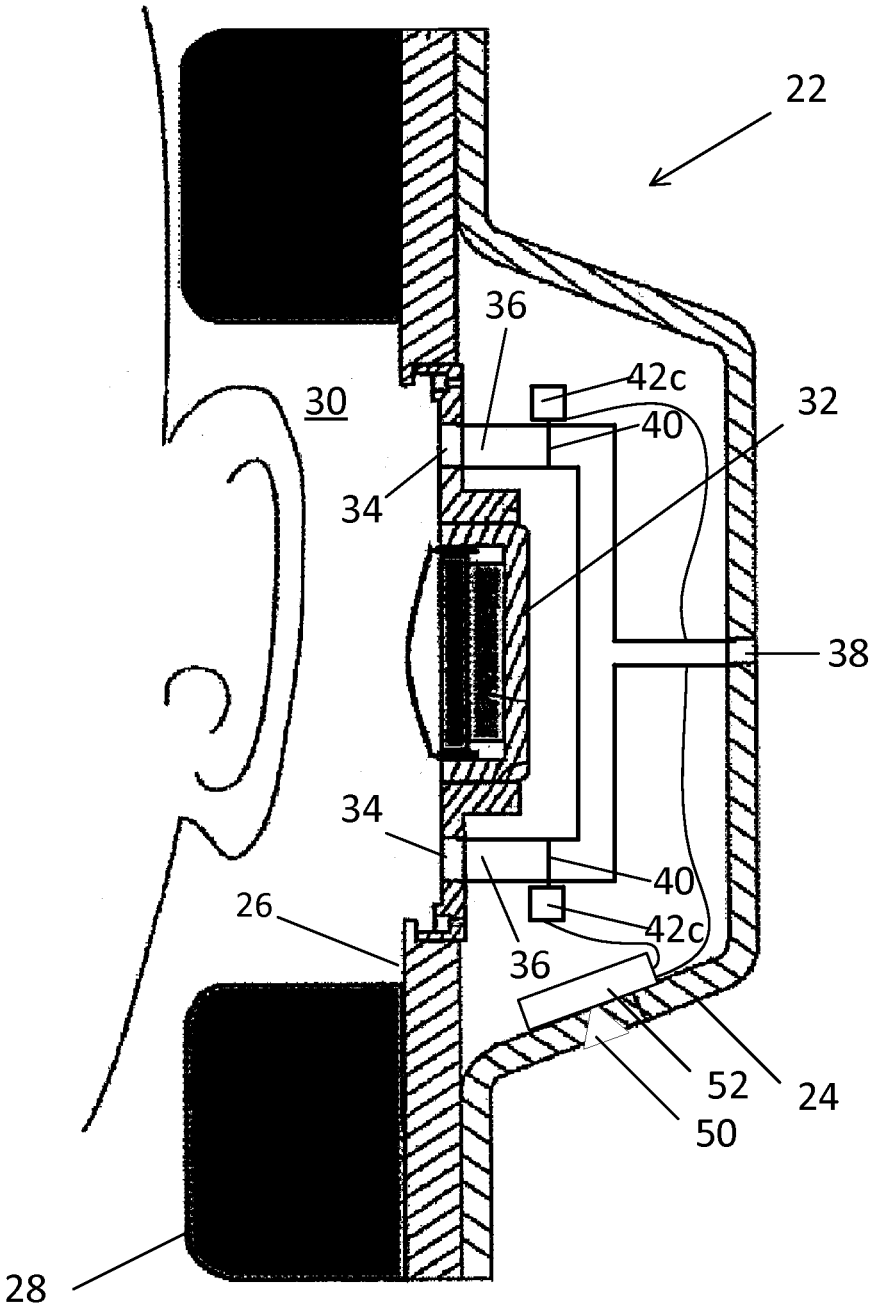
FIG. 4 is a vertical cross sectional view of headphones according to a first preferred embodiment of the invention, showing an electrostrictive element operator.
Figure 5:
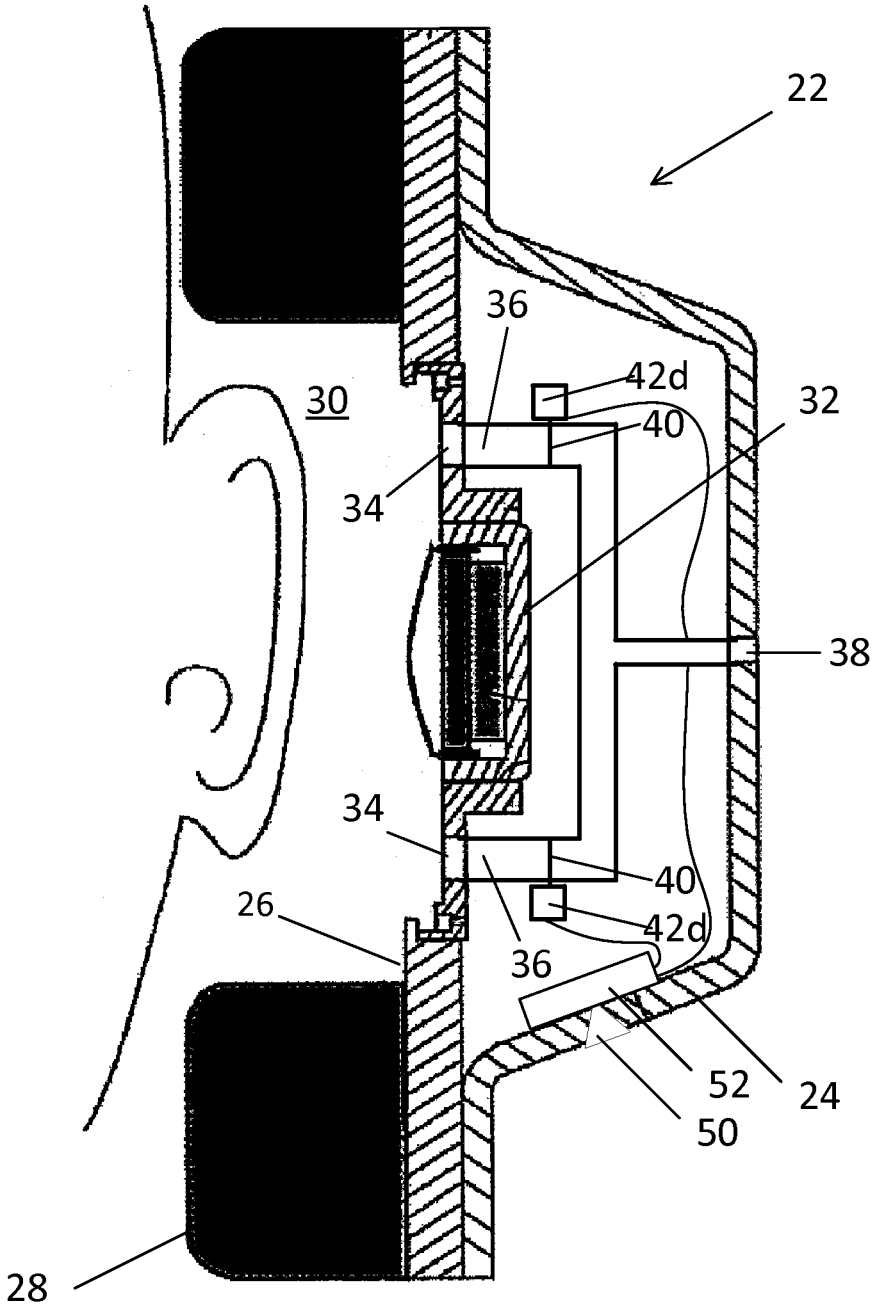
FIG. 5 is a vertical cross sectional view of headphones according to a first preferred embodiment of the invention, showing a solenoid element.

As shown in FIG. 2, the operator can comprise an electric motor 42*a*, or a piezoelectric element (42*b* in FIG. 3), an electrostrictive element (42*c* in FIG. 4), a solenoid (42*d* in FIG. 5), or other suitable means. In some embodiments, the valve member 40 is disposed intermediate the port 34 and the opening 38 to the exterior of the housing. In other embodiments the valve member 40 is located at the port 34 in the face 26 of the housing 24, as shown in FIG. 6. In still other embodiments the valve member 40 can be located at the opening 38 of the passage to the exterior of the housing.

The earpiece 22 preferably further comprises a sensor 50 for sensing sound signals outside the housing; and a processor 52 programmed to process the sensed sound, and in response to the processed sound signal control the operator 42 to operate the valve member 40. The sensor 50, e.g., a microphone, can be incorporated into the housing 24 as shown, or it could be external to the housing. The processor 52 can be programmed to control the operator 42 to move the valve member 40 to an open position based upon at least one of the volume, frequency, or duration of the sensed sound. For example, the processor is programmed to control the operator to move the valve member to an open position when the sensor senses sound in excess of a predetermined threshold (for example an alarm or an emergency siren), or when the sensor senses sound in excess of a predetermined threshold for a predetermined period of time (for example an alarm or an emergency siren), or when the sensor senses a repeated sound (for example a verbal warning). The processor 52 may also after (interrupt or reduce volume) the sound signal being delivered to the main speaker 32.

While a wired connection is shown between the processor 52 and the operators 32, the connection could be a wireless signal, such as a blue tooth or blue tooth le signal. A wireless connection facilitates separating the sensor 50 and processor 52 from the headphones.

While the valve member 42 is operable between an open and closed position, it is preferably also operable to intermediate positions so that the level of ambient sound can be modulated. For example the control 52 can operate to slowly open the valve member so that the level of ambient sound gradually rises, or otherwise control the level of ambient sound delivered based upon a number of factors including the volume of sound being transmitted by the speaker 32, the level of ambient sound, user preferences, or other factors, Generally, an adjustable occlusion earpiece in accordance with the principles of a second preferred embodiment of this invention is indicated generally as 22' in FIGS. 7 and 8. The earpiece 22' comprises a housing 24 having a face 26, and a resilient seal member 28 on the housing, adapted to surround the user's ear, and with the face of the housing form a chamber 30 enclosing the user's ear. A speaker 32 is disposed in the housing and communicates through the face 26 of the housing 24 to provide sound to the user's ear.

The earpiece 22' preferably further comprises a sensor 60 for sensing sound signals outside the housing; and a processor 62 programmed to process the sensed sound, and in response to the processed sound signal send a sound signal to the speaker 32. The processor 62 can either replace the sound signal with the ambient sound signal, or mix the sound signal and the ambient sound signal. In an alternative construction of the second preferred embodiment shown in FIG. 8, auxiliary speakers 64 are provided and the processor 62 sends the ambient sound signals to the auxiliary speakers rather than the main speaker 32 of the earphone. The processor 62 may or may not also alter (interrupt or reduce volume) the sound signal being delivered to the main speaker 32.

The processor 62 can be programmed to transmit ambient sound signals to the speaker 32 or the auxiliary speakers 64 based upon at least one of the volume, frequency, or duration of the sensed sound. For example, the processor is programmed to transmit sound to the speaker 32 or the auxiliary speaker 64 when the sensor senses sound in excess of a predetermined threshold (for example an alarm or an emergency siren), or when the sensor senses sound in excess of a predetermined threshold for a predetermined period of time (for example an alarm or an emergency siren), or when the sensor senses a repeated sound (for example a verbal warning). The control 62 can modulate the level of volume of the sound transmitted to the speakers, for example gradually ramping up the sound, for example the control 62 can modulate the ambient sound signal so that the level of ambient sound gradually rises, or otherwise control the level of ambient sound delivered based upon a number of factors including the volume of sound being transmitted by the speaker 32, the level of ambient sound, user preferences, or other factors, The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustable occlusion headphone comprising:

a housing having a face, a resilient seal member on the housing, adapted to surround an ear of a user, and with the face of the housing forming a chamber enclosing the user's ear;

a speaker communicating through the face of the housing to provide sound to the user's ear;

at least one port in the face of the housing; a passage extending from each port to an exterior of the housing;

a valve member associated with each passage, operable between an open position and a closed position;

an operator for operating each valve member between its open and closed position to control sound communication from outside the housing to the chamber;

a sensor for sensing sound outside the housing; and a processor programmed to:

process the sensed sound, control the operator to move the valve member to an open position based on at least one of a volume, frequency, or duration of the sensed sound, and communicate the sensed sound to the speaker when the sensed sound includes a repeated sound.

2. The adjustable occlusion headphone of claim 1 wherein the operator comprises an electric motor.

3. The adjustable occlusion headphone of claim 1 wherein the operator comprises a piezo electric element.

4. The adjustable occlusion headphone of claim 1 wherein the operator comprises a solenoid.

5. The adjustable occlusion headphone of claim 1 wherein the valve member is disposed in the port in the face of the housing.

6. The adjustable occlusion headphone of claim 1 wherein the valve member is disposed in the passage intermediate the port and an exterior of the housing.

7. The adjustable occlusion headphone of claim 1 wherein the processor is further programmed to control the operator to move the valve member to an open position when the sensor senses sound in excess of a predetermined threshold.

8. The adjustable occlusion headphone of claim 1 wherein the processor is further programmed to control the operator to move the valve member to an open position when the sensor senses sound in excess of a predetermined threshold for a predetermined period of time.

9. The adjustable occlusion headphone of claim 1 wherein the processor is further programmed to control the operator to move the valve member to an open position when the sensor senses a repeated sound.

10. An adjustable occlusion headphone comprising:

a housing having a face, a resilient seal member on the housing, adapted to surround a user's ear, and with the face of the housing forming a chamber enclosing the user's ear, the face including at least one port, the housing defining a passage extending from the port to an exterior of the housing;

a speaker communicating through the face of the housing to provide sound to the user's ear;

a valve member within the passage and operable between an open position and a closed position;

an operator for moving the valve member between its open and closed position;

a sensor for sensing sound outside the housing; and a processor programmed to process the sensed sound, control the operator to move the valve member to an open position based on at least one of a volume, frequency, or duration of the sensed sound, and selectively transmit and communicate the sensed sound to the speaker in response to the sensed sound including a repeated sound.

11. The adjustable occlusion headphone of claim 10 wherein the processor is further programmed to communicate the sensed sound to the speaker based upon at least one of a volume, frequency, or duration of the sensed sound.

12. The adjustable occlusion headphone of claim 10 wherein the processor is further programmed to communicate the sensed sound to the speaker in response to the sensed sound having an amplitude in excess of a predetermined threshold.

13. The adjustable occlusion headphone of claim 10 wherein the processor is further programmed to communicate the sensed sound to the speaker when the sensed sound includes an amplitude in excess of a predetermined threshold for a predetermined period of time.

14. The adjustable occlusion headphone of claim 1 wherein the processor is further programmed to replace the sound being provided by the speaker with the sensed sound in response to the sensed sound including the repeated sound.

15. The adjustable occlusion headphone of claim 14 wherein the processor is further programmed to gradually increase a volume of the sensed sound provided by the speaker.

16. The adjustable occlusion headphone of claim 1 wherein the processor is configured to control the operator to gradually move the valve from a closed position to the open position to gradually increase a volume of the sensed sound provided through the passage.

17. A headphone system, comprising:

at least one earpiece housing including a speaker and at least one passage extending from a port in a face of the earpiece housing to an exterior of the housing;

a valve member within the passage operable between an open position and a closed position;

an operator for moving the valve member between its open and closed position;

a sensor arranged within the earpiece housing and configured to receive ambient sound; and a processor in communication with the sensor and the speaker and configured to:

control the operator to move the valve member to an open position based on at least one of a volume, frequency, or duration of the ambient sound, determine whether the ambient sound includes a repeated sound, and communicate, in response to the ambient sound including a repeated sound, the ambient sound to the speakers.

18. The headphone system of claim 17, wherein the processor is further configured to replace a user selected sound being provided by the speaker with the ambient sound in response to the ambient sound including the repeated sound.

19. The headphone system of claim 17, wherein the processor is further configured to gradually increase a volume of the ambient sound provided by the speaker.

* * * * *